United States Patent [19]

Chen et al.

[11] Patent Number: 4,794,378

[45] Date of Patent: Dec. 27, 1988

[54] GRAVITATIONALLY-ACTUATING MISSING REMINDER FOR POCKET ARTICLE

[76] Inventors: Sheng-Chuan Chen; Wen-Tsung Lin, both of P.O. Box 30-443, Taipei, Taiwan

[21] Appl. No.: 137,328

[22] Filed: Dec. 23, 1987

[51] Int. Cl.[4] ..... G08B 13/14

[52] U.S. Cl. ..... 340/571; 340/568; 200/61.58 R; 200/61.83

[58] Field of Search ..... 340/568, 571, 572, 546, 340/585, 573; 200/33 A, 61.83, 61.45 R, 61.52, 61.47, 61.71, 61.72, 61.58 R, 61.62, 61.76; 401/151, 190, 194, 195

[56] References Cited

U.S. PATENT DOCUMENTS

| | | | |
|---|---|---|---|
| 4,104,492 | 8/1978 | Plime, Jr. | 200/61.52 |
| 4,291,301 | 9/1981 | Chan | 340/568 |
| 4,652,865 | 3/1987 | Maharshak | 340/568 |
| 4,668,846 | 5/1987 | Klumpp | 200/61.83 |
| 4,721,948 | 2/1988 | Lin | 340/568 |

*Primary Examiner*—Joseph A. Orsino
*Assistant Examiner*—Anh H. Tran

[57] ABSTRACT

A missing reminder for pocket article includes: a wallet for storing credit card or the like, a gravitational actuator clamped on the wallet and an alarming circuit which is operatively sensed when withdrawing the wallet from an owner's pocket by seating a weight disk of the actuator on a receiver to close two contacts of the alarming circuit formed on the receiver to sound the alarm and give warning to the wallet owner.

6 Claims, 2 Drawing Sheets

GRAVITATIONALLY-ACTUATING MISSING REMINDER FOR POCKET ARTICLE

BACKGROUND OF THE INVENTION:

McGahee disclosed a credit card monitor in his U.S. Pat. No. 3,959,789 which consists of a plurality of switches formed from conductive means affixed to the surface of separators in a card carrying case. The separators are biased together and the electrical contacts affixed thereto are interconnected to form a plurality of normally closed, electrically parallel switches. The switches are interconnected to provide electrical current to a time delay means which is adapted to energize a sensory warning a predetermined time after closure of one of the switches. In its normal operation, credit cards are inserted between all of the separators so that removal of any card will result in the closure of one switch to sense the warning for reminding its owner.

However, if a thief of pickpocket who may steal the complete card carrying case other than an individual card without removing any card from the carrying case and without sensing the alarm so that McGahee's device still can not serve as a satisfactory security means such as for warning a pickpocket behavior. It is therefore to expect a warning device for sensing an alarm when completely removing a wallet, a valuable card or document from an owner's pocket by a thief or pickpocket for ensuring the security of the owner's articles kept in his or her pocket.

SUMMARY OF THE INVENTION

The object of the present invention is to provide a missing reminder for pocket article including: a wallet for storing credit cards or valuable documents, a gravitational actuator clamped on the wallet, and an alarming means which is operatively sensed by the gravitational actuator when removing the wallet from an owner's pocket by contacting a weight within a tube of the actuator to close two contacts of an alarming circuit, thereby sounding the alarming means and warning the wallet owner about the possible missing of his or her wallet or valuable documents.

BRIEF DESCRIPTION OF THE DRAWINGS

FIG. 8 shows still another preferred embodiment of the present invention by clamping the gravitational actuator on a credit card or the like.

Figure 1:
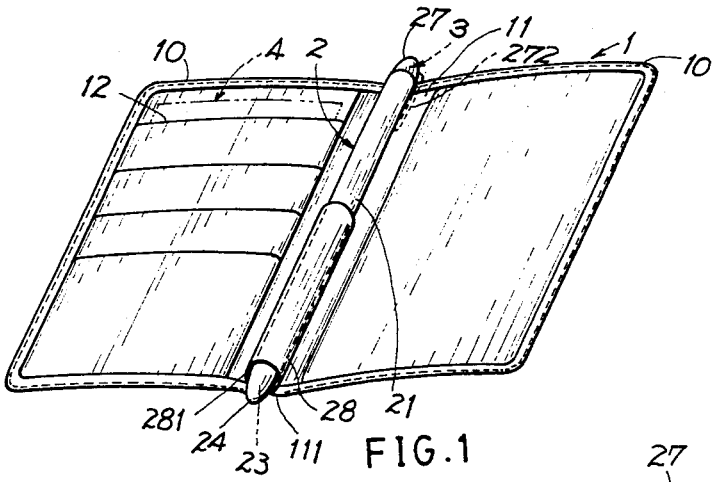
FIG. 1 is a perspective illustration of the present invention.

DETAILED DESCRIPTION:

As shown in FIGS. 1–4, the present invention comprises: a wallet 1, a gravitational actuator 2, and an alarming means 3.

The wallet 1 includes: two leaves 10 foldable upon each other, a central folding portion 11 formed between the two leaves 10, and plural bags 12 formed on the leaves 10 adapted for inserting a cedit card 4 or other valuable documents in the bags.

The gravitational actuator 2 includes: an outer tube 21 movably clamped on the wallet 1 and jacketed in a sliding pipe 28 fixed on the central folding portion 11 having a lower periphery 281 of the pipe 28 coinciding with a bottom edge 111 of the wallet 1, an inner tube 22 having a lower plug 23 which is normally sealed by a bottom cap 24 and fixed on a lower end of the inner tube 22, a weight disk 25 preferably made of magnet mounted on an upper portion of the inner tube 22, a contactor receiver 26 made of insulating material retained on a central portion inside the outer tube 21, and a top cap 27 formed on a top end of the outer tube 21 having a clip 272 for clamping the actuator 2 on the wallet 1.

The top cap 27 is shaped for the temporary mounting of the bottom cap 24 thereon and is also drilled with plural perforations 271 for the spreading of alarming sound from a buzzer 31 fixed in the cap 27.

The outer tube 21 is formed with a hollow cylindrical hole 210 for slidingly moving the weight disk 25. The lower opening edge 211 of the outer tube 21 is operatively contacting an upper edge 231 of the lower plug 23.

The alarming means 3 includes: a buzzer 31 having a first terminal electrically connecting a negative pole of a battery 32 by a first left wire 311 and having a second terminal of the buzzer 31 electrically connecting a right wire 312 embedded inside the outer tube 22 having a right contact 313 formed on an upper surface 260 of the contactor receiver 26; and a battery 32 formed between the inner tube 22 and the top cap 27 having a positive pole electrically connecting a second left wire 321 embedded inside the tube 21 having a left contact 322 formed on an upper surface of the receiver 26 opposite to the right contact 313.

Figure 4:
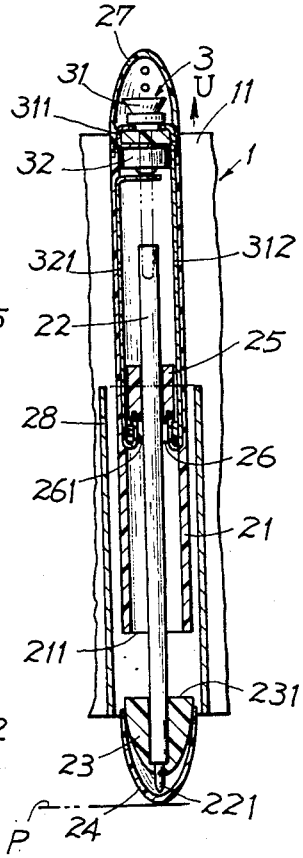
FIG. 4 is an illustration showing an operaton of an inner tube and the weight to sound the alarming means of the present invention.

The weight disk 25 fixed on the inner tube 22 is formed with an electrically conductive annular plate 251 on its bottom surface 252. A distance between the disk bottom 252 and the wallet bottom edge 111 should be larger than a distance between the upper surface 260 of receiver 26 and the bottom edge 111. The inner tube 22 loaded with the weight disk 25 gravitationally descends through a central through hole 261 vertically formed through the receiver 26 so as to allow the electrically conductive annular plate 251 to contact the two contacts 322, 313 when seating or contacting the disk 25 on the receiver 26 and to protrude the lower plug 23 downwardly beyond the bottom edge 111 of wallet 1, as shown in FIG. 4. The receiver 26 is inserted with ferrous material 262 to magnetically attract the annular plate 251 of weight disk 25.

When inserting the wallet 1 into a user's pocket, the lower plug 23 (sealed with a bottom cap 24) may be retracted into the pipe 28 as retarded by a pocket bottom P to raise or suspend the disk 25 upwardly to separate from the receiver 26 to open an alarming circuit consisting of the buzzer 31 and the battery 32.

When the wallet 1 is, for instance, withdrawn from a user's pocket by a thief or pickpocket (direction U) as shown in FIG. 4, the lower plug 23 is still retained at the pocket bottom P and the upward movement of the outer tube 21 with the receiver 26 will allow the weight disk 25 to gravitationally close the two contacts 322, 313 of the buzzer 31 as formed on the receiver 26, resulting in an alarm sounding for warning the wallet 1 being stolen.

Figure 5:
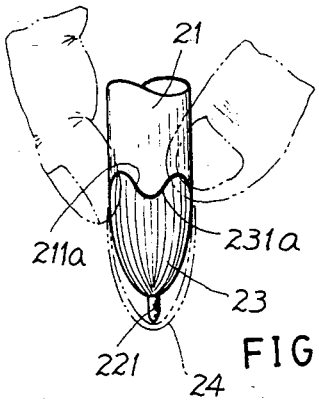
FIG. 5 is a partial illustration showing a lower portion of another preferred gravitational actuator of the present invention.

If the inner tube 22 is filled with ink and provided with a ball point 221, the actuator 2 may be withdrawn from the wallet for additional writing use. At this time, the lower plug 23 is raised to contact the lower edge 211 of outer tube 21 to open the alarm circuit to prevent its sounding. For firm grasping purpose, both the lower edge 211*a* of outer tube 21 and upper edge 231*a* of plug 23 may be made of corrugations as shown in FIG. 5 whereby a user's fingers may grasp a boundary area between the two corrugated edges 211*a*, 231*a* for stable writing purpose without loosening the plug 23 from the tube 21 since they should be normally freely unengaged.

Figure 6:
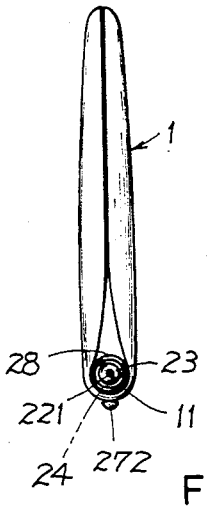
FIG. 6 is a bottom view of the present invention as folded.

The sliding pipe 28 plays an important role in this invention, since when folding the two leaves 10 of the wallet 1 as shown in FIG. 6 the plug 23 as freely jacketed within the pipe 28 can gravitationally fall down to actuate the alarming means 3 without being frictionally clamped by the two leaves 10.

Figure 7:
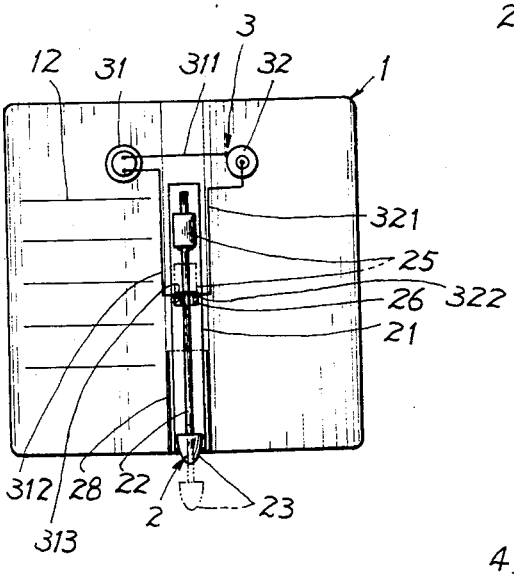
FIG. 7 shows another preferred embodiment of the present invention when the gravitational actuator is built in the wallet.

Another preferred embodiment of the present invention is shown in FIG. 7 which includes: a wallet 1; a gravitational actuator 2 having an outer tube 21 mounted on the wallet, an inner rod 22 slidingly moving in the outer tube 21 fixed with a lower plug 23 on a lower end of rod 22 and fixed with a metallic weight disk 25 on an upper portion of rod 22, an contactor receiver 26 fixed on a central portion inside the outer tube 21 and a sliding pipe 28 jacketed outside the outer tube 21 and the lower plug 23; and an alarming means 3 mounted on wallet having a buzzer 31 electrically driven by a battery 32, having a left wire 312 electrically connected to the buzzer 31 and connected to a left contact 313 formed on the receiver 26 and having a right wire 321 electrically connected to the battery 32 and connected to a right contact 322 formed on the receiver 26 opposite to the left contact 313.

The disk 25 is normally suspending above the receiver 26 when raising the lower plug 23 (such as upwardly retained by a pocked bottom when putting the wallet in a pocket), which is normally protruding when putting the wallet in a pocket), which is normally protruding downwardly beyond a bottom edge of the wallet 1, to open an alarming circuit of the alarming means 3.

When withdrawing the wallet 1 from a user's pocket, the plug 23 is still retained at the pocket bottom and the weight disk 25 will close the two contacts 313, 322 as formed on receiver 26 which is raised along with the wallet as being upwardly withdrawn towards the disk 25, for sounding the alarming means 3 and warning the wallet owner.

Figure 8:
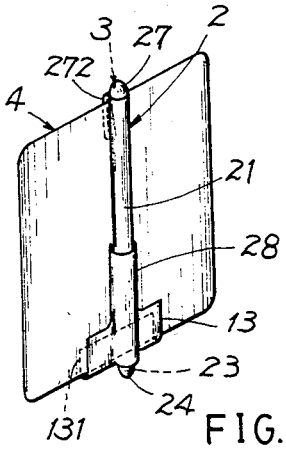

Still another preferred embodiment of the present invention is sown in FIG. 8, which comprises: a gravitational actuator 2 as aforesaid having a clip 272 clamped on a credit card 4 or the like, a sliding pipe 28 slidingly disposed around the outer tube 21 of the actuator 2, and a clamping holder 13 securing the pipe 28 thereon having a clamp 131 for clamping a lower portion of the card 4 or the like. For simplifying purpose, the pipe 28 and holder 13 can be omitted and the actuator 2 can be directly clamped on the card for security use. Once, the card 4 is withdrawn from a user's pocket the alarming means 3 in the actuator 2 will be sounding to give warning signal.

Figure 2:
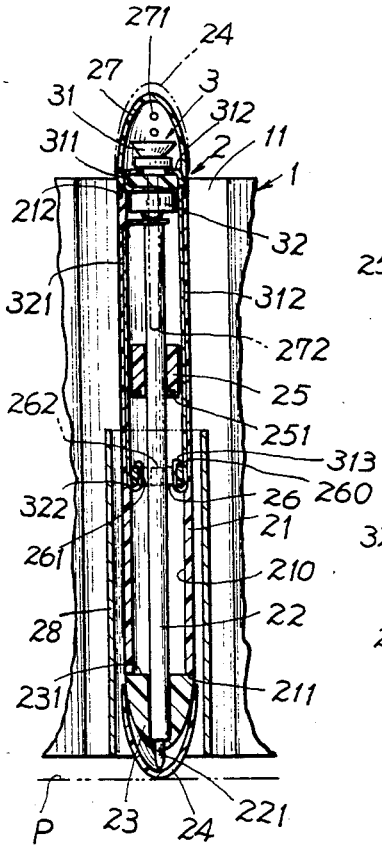
FIG. 2 is a sectional drawing of the present invention.
Figure 3:
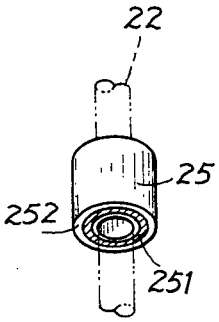
FIG. 3 shows a weight disk in accodance with the present invention.
Figure 3A:
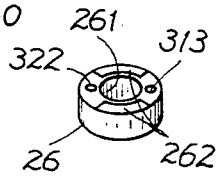
FIG. 3*a* shows a receiver with ferrous material of the present invention

When closing the disk 25 with the receiver 26, the disk with magnet 25 will be attracted to the ferrous material 262 formed in the receiver 26 as shown in FIG. 3A to thereby make stable electrical contact to ensure the continuous alarm sounding when vibrationally withdrawing the wallet. The magnetic attraction will be released to separate the disk 25 from the receiver 26 when inserting the wallet into a pocket bottom P as shown in FIG. 2 ready for next warning operation.

We claim:

1. A missing reminder for pocket article comprising:

a wallet normally stored in a user's pocket having two leaves foldable upon each other and having bags therein for storing credit cards or valuable documents;

a gravitational actuator including an outer tube clamped on a central folding portion intermediate between the two leaves of said wallet, an inner tube having a lower plug formed on a lower end of said inner tube movably sliding within the outer tube, a weight disk mounted on an upper portion of said inner tube, a contactor receiver made of insulating material retained on a central portion inside said outer tube having a central through hole formed therein slidably engageable with said inner tube, a top cap formed on a top end of said outer tube and a sliding pipe jacketing on said outer tube and slidingly moving said lower plug of said inner tube within said pipe, said pipes having a lower opening edge coinciding with a bottom edge of said wallet; and an alarming means having a buzzer and a battery stored in said outer tube, said buzzer having one electric terminal electrically connecting a right wire having a right contact formed on said contactor receiver and having the other electric terminal of said buzzer electrically connecting said battery and a left wire having a left contact formed on said receiver opposite to said right contact;

said weight disk, normally suspending above said receiver when said lower plug being raised upwardly as retained by a user's pocket, having an electrically conductive plate formed on a bottom surface of said weight disk and gravitationally descending to seat on said contactor receiver to close two said contacts of said buzzer for sounding said buzzer when upwardly removing said wallet from a user's pocket.

2. A missing reminder for pocket article according to claim 1, wherein said inner tube of said gravitational actuator is filled with ink and formed with a ball point in said lower plug so that said actuator is withdrawn from said wallet for writing purpose, said lower plug normally sealed by a bottom cap.

3. A missing reminder for pocket article comprising: a wallet; a gravitational actuator having an outer tube mounted on said wallet, an inner rod having a lower plug slidingly moving within said outer tube, a metallic weight disk formed on an upper portion of said inner rod, a contactor receiver formed on a central portion inside said outer tube, and a sliding pipe mounted on said wallet and jacketed around the outer tube; and an alarming means having a buzzer, a battery and two contacts respectively formed on said receiver; said buzzer having a wire electrically connecting a left contact formed on said receiver and said battery having a wire electrically connecting a right contact formed on said receiver opposite to said left contact; said weight disk operatively suspending above said receiver and gravitationally descending to seat on said receiver to close said two contacts to electrically connect the buzzer with the battery for sounding said buzzer.

4. A missing reminder for pocket article comprising: a gravitational actuator having the limitations as set forth in claim 1 operatively clamped on an upper portion of a credit card; and a clamping holder secured to a sliding pipe jacketed on said actuator and operatively clamping a lower portion of the credit card.

5. A missing reminder according to claim 1, wherein said top cap is drilled with plural perforations and is stored with said buzzer, said top cap having a clip for clamping said actuator on said wallet.

6. A missing reminder according to claim 1, wherein said weight disk is made of magnet and said receiver is inserted with ferrous material thereon for the magnetic attraction therebetween.

* * * * *